US012509274B2

(12) United States Patent
Dayioglu et al.

(10) Patent No.: US 12,509,274 B2
(45) Date of Patent: Dec. 30, 2025

(54) CONTAINER HAVING BOX AND SLEEVE WITH LOCKING MECHANISM

(71) Applicant: PHILIP MORRIS PRODUCTS S.A., Neuchatel (CH)

(72) Inventors: Onur Dayioglu, Neuchatel (CH); Ross Lange, Neuchatel (CH); Julie Polier, Neuchatel (CH); Digvijay Singh, Pully (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 17/602,815

(22) PCT Filed: Aug. 14, 2020

(86) PCT No.: PCT/EP2020/072871
§ 371 (c)(1),
(2) Date: Oct. 11, 2021

(87) PCT Pub. No.: WO2021/032621
PCT Pub. Date: Feb. 25, 2021

(65) Prior Publication Data

US 2022/0161959 A1 May 26, 2022

(30) Foreign Application Priority Data

Aug. 16, 2019 (EP) ..... 19192176

(51) Int. Cl.
*B65D 5/38* (2006.01)
*B65D 5/42* (2006.01)
*B65D 85/10* (2006.01)

(52) U.S. Cl.
CPC ..... *B65D 5/38* (2013.01); *B65D 85/1045* (2013.01); *B65D 5/4266* (2013.01)

(58) Field of Classification Search
CPC .... B65D 5/38; B65D 5/4266; B65D 85/1036; B65D 5/6691; B65D 5/6697
See application file for complete search history.

(56) References Cited

U.S. PATENT DOCUMENTS 11,230,405 B2 * 1/2022 Fahlke ..... B65D 50/046
11,319,108 B2 * 5/2022 Gauvin ..... B65D 5/38
(Continued)

FOREIGN PATENT DOCUMENTS

EP 3090955 11/2016
EP 3090955 A1 * 11/2016 ..... B65D 5/725
(Continued)

OTHER PUBLICATIONS

PCT International Search Report and Written Opinion for PCT/EP2020/072871 dated Jan. 26, 2021 (10 pages).
(Continued)

*Primary Examiner* — Ernesto A Grano
*Assistant Examiner* — Symren K Sanghera
(74) *Attorney, Agent, or Firm* — Mueting Raasch Group

(57) ABSTRACT

A container (1) for consumer goods, the container comprises an outer sleeve (20) and inner box (10) disposed within the outer sleeve (20), and configured to slide within the outer sleeve (20) between: a first position, in which the interior of the inner box (10) cannot be accessed by a user; and a second position, in which the interior of the inner box (10) can be accessed by a user. The container (1) having a locking mechanism for preventing the inner box (10) from sliding from the first position to the second position, when the inner box (10) is in the first position in the outer sleeve (20).

11 Claims, 5 Drawing Sheets

(56) References Cited

U.S. PATENT DOCUMENTS

| | | | | |
|---|---|---|---|---|
| 11,365,022 | B2 * | 6/2022 | Altman | B65D 43/20 |
| 11,628,990 | B2 * | 4/2023 | Chambers | B65D 50/066 206/1.5 |
| 2011/0062175 | A1 * | 3/2011 | Nakamura | B65D 85/1054 220/810 |
| 2016/0325873 | A1 | 11/2016 | Smith | |
| 2018/0370716 | A1 | 12/2018 | Draghetti | |
| 2019/0062023 | A1 * | 2/2019 | Lantz | B65D 77/0433 |
| 2019/0359399 | A1 * | 11/2019 | Gauvin | B65D 5/38 |
| 2021/0016939 | A1 * | 1/2021 | Palmer | B65D 5/38 |
| 2022/0315272 | A1 * | 10/2022 | Whitehurst | B65D 5/38 |

FOREIGN PATENT DOCUMENTS

| | | | | |
|---|---|---|---|---|
| EP | 3623308 | A1 * | 3/2020 | B65D 5/38 |
| JP | 54-104324 | | 7/1979 | |
| WO | WO 2009/148034 | | 12/2009 | |
| WO | WO 2010/058237 | | 5/2010 | |
| WO | WO 2011/154822 | | 12/2011 | |
| WO | Wo 2018/190910 | | 10/2018 | |
| WO | WO 2021/032619 | | 2/2021 | |
| WO | WO-2021122727 | A1 * | 6/2021 | B65D 5/4266 |

OTHER PUBLICATIONS

Extended European Search Report for Application No. 19192176.6 dated Dec. 9, 2019 (7 pages).
Office Action issued in Japan for Application No. 2022-504653 dated Feb. 1, 2024 (14 pages). English translation included.
Office Action issued in India for Application No. 202117040549 dated Nov. 7, 2025 (7 pages). English translation included.

* cited by examiner

CONTAINER HAVING BOX AND SLEEVE WITH LOCKING MECHANISM

This application is a U.S. National Stage Application of International Application No. PCT/EP2020/072871 filed Aug. 14, 2020, which was published in English on Feb. 25, 2020, as International Publication No. WO 2021/032621 A1. International Application No. PCT/EP2020/072871 claims priority to European Application No. 19192176.6 filed Aug. 16, 2019.

The present invention relates to a container for consumer goods. Containers according to the invention find particular application as containers for aerosol generating articles or components of aerosol generating articles.

It is known to package consumer articles in containers formed from folded laminar blanks. By way of example, elongate smoking articles, such as cigarettes and cigars, are often sold in rigid box shaped containers, such as hinged lid containers having a box portion and a three-dimensional cup shaped hinge lid connected to the box about a hinge line extending across the back wall of the container. In use, the lid is pivoted about the hinge line to open the pack and so gain access to the consumer articles held in the box.

It is also known to package consumer goods in containers comprising an outer shell or sleeve and an inner slide or box in which the consumer goods are housed and which is slidable within the outer shell. To remove consumer goods from such containers, a user slides the inner slide from an initial position within the outer shell to an open position in which the inner slide projects outwardly from the outer shell, in order to partially expose an open end or side of the inner slide. Such containers may be referred to as a slide-and-shell container.

It may be desirable to ensure that the inner slide or inner box remains enclosed within the outer shell until a user is ready to access the consumer goods. For example, it may be desirable to ensure that the lid remains in the closed position when the container is being transported. This may help to prevent the consumer goods from inadvertently falling out of the container. This may help to preserve one or more properties of the consumer goods, such as their freshness.

It would be desirable to provide a novel and improved container for consumer goods which is configured to reduce the risk of a lid of the container inadvertently moving from the closed position to the open position. Further, it would be desirable to provide one or more laminar blanks and a method for forming one such improved container, wherein the manufacturing process is straightforward and cost-effective.

According to the present disclosure, there is provided a container for consumer goods. The container comprises: an outer sleeve comprising an outer sleeve front wall, an outer sleeve back wall, first and second opposed outer sleeve side walls, and a first open end; and an inner box disposed within the outer sleeve. The inner box is configured to be slidable with respect to the outer sleeve between: a first position, in which the interior of the inner box cannot be accessed by a user; and a second position, in which the interior of the inner box can be accessed by a user. Sliding of the inner box from the first position to the second position involves at least part of the inner box passing through the first open end of the outer sleeve. The inner box comprises an inner box top wall, an inner box bottom wall, an inner box front wall, an inner box back wall, first and second opposed inner box side walls, and first and second inner box side flaps, each inner box side flap being configured to overlie a portion of the outer surface of a respective inner box side wall. When the inner box is in the first position in the outer sleeve, an edge of each inner box side flap is configured to engage with a corresponding engaging element on the inner surface of a respective outer sleeve side wall, to form a locking mechanism for preventing the inner box from sliding from the first position to the second position.

In some preferred embodiments, the inner box further comprises a box portion and a lid portion hingedly attached to the box portion along a hinge line. The box portion may have an interior configured to house one or more consumer goods. The lid portion may be configured to cover an access opening of the box portion of the inner box.

The lid portion may comprise a lid portion top wall, a lid portion front wall, a lid portion back wall, and first and second opposed lid portion side walls. The box portion may comprise a box portion front wall, box portion top wall, and first and second opposing box portion side walls. The inner box top wall, inner box bottom wall, inner box front wall, inner box back wall, and first and second opposed inner box side walls may be defined by the corresponding walls of the box portion and the lid portion.

In some embodiments, each of the first and second inner box side flaps depends from an edge of the box portion connecting their respective box portion side wall with the box portion bottom wall. In other embodiments, each of the first and second inner box side flaps depends from an edge of the lid portion connecting their respective lid portion side wall with the lid portion top wall. These two sets of embodiments may provide a number of advantages, such as those described in more detail in the following two paragraphs.

For example, as noted above in some embodiments, each of the first and second inner box side flaps may be configured to overlie a portion of the outer surface of a respective lid portion side wall. That is, the first inner box side flap may overlie a portion of the outer surface of the first lid portion side wall, and the second inner box side flap may overlie a portion of the outer surface of the second lid portion side wall. In such embodiments, each of the first and second inner box side flaps may depend from an edge of the lid portion which connects their respective lid portion side wall with the lid portion top wall. This may provide one or more advantages from a manufacturing perspective. For example, with such an arrangement the lid portion may be formed from a single laminar blank, with the first and second inner box side flaps being formed from the same single laminar blank. In particular, the first and second inner box side flaps may be formed from parts of the laminar blank which would normally be used to form reinforcing flaps for the lid portion. However, instead of being folded to reside inside the lid portion, said reinforcing flaps can be left unfolded such that they reside on the outside of the lid portion, and thus provide the first and second inner box side flaps. The first and second inner box side flaps may therefore be provided as part of an inner box, without substantially modifying one or both of the components and processes used to form said inner box.

Alternatively or additionally, as noted above, in some embodiments, each of the first and second inner box side flaps may be configured to overlie a portion of the outer surface of a respective box portion side wall. That is, the first inner box side flap may overlie a portion of the outer surface of the first box portion side wall, and the second inner box side flap may overlie a portion of the outer surface of the second box portion side wall. In such embodiments, each of the first and second inner box side flaps may depend from an edge of the box portion which connects their respective box portion side wall with the box portion bottom wall. This may provide one or more advantages from a manufacturing perspective. For example, with such an arrangement the box portion may be formed from a single laminar blank, with the first and second inner box side flaps being formed from the same single laminar blank. In particular, the first and second inner box side flaps may be formed from parts of the laminar blank which would normally be used to form reinforcing flaps for the box portion. However, instead of being folded to reside inside the box portion, said reinforcing flaps can be left unfolded such that they reside on the outside of the box portion, and thus provide the first and second inner box side flaps. The first and second inner box side flaps may therefore be provided as part of an inner box, without substantially modifying one or both of the components and processes used to form said inner box. The present disclosure therefore also provides a container for consumer goods, where the container comprises: an outer sleeve comprising an outer sleeve front wall, an outer sleeve back wall, first and second opposed outer sleeve side walls, and a first open end; and an inner box comprising: a box portion comprising a box portion bottom wall, a box portion front wall, a box portion back wall, and first and second opposed box portion side walls; and a lid portion hingedly attached to the box portion along a hinge line, the lid portion comprising a lid portion top wall, a lid portion front wall, a lid portion back wall, and first and second opposed lid portion side walls, where the inner box is disposed within the outer sleeve and configured to be slidable with respect to the outer sleeve between: a first position, in which the interior of the inner box cannot be accessed by a user; and a second position, in which the interior of the inner box can be accessed by a user. Sliding of the inner box from the first position to the second position involves at least part of the inner box passing through the first open end of the outer sleeve. The inner box further comprises first and second inner box side flaps, each inner box side flap being configured to overlie a portion of the outer surface of a respective box portion side wall or lid portion side wall. When the inner box is in the first position in the outer sleeve, an edge of each inner box side flap is configured to engage with a corresponding engaging element on the inner surface of a respective outer sleeve side wall, to form a locking mechanism for preventing the inner box from sliding from the first position to the second position. Each of the first and second inner box side flaps depends from an edge of the box portion connecting their respective box portion side wall with the box portion bottom wall; or each of the first and second inner box side flaps depends from an edge of the lid portion connecting their respective lid portion side wall with the lid portion top wall.

Such an inner box side flap and corresponding engaging arrangement forms at least part of a locking mechanism for the container. By providing the container with such a locking mechanism the container can be left in a locked state, in which the interior of the inner box cannot be accessed. This means that the container can be locked when not in use. The locking mechanism may therefore help to reduce the risk of inadvertent opening of the container. This may help to prevent the consumer goods from inadvertently falling out of the container. This may help to preserve one or more properties of the consumer goods, such as their freshness.

By providing the container according to the present invention, at least part of the locking mechanism may be hidden from the outer appearance of the container. This can mean that the locking mechanism is less obviously visible. This may help to reduce the risk of the container becoming inadvertently unlocked. More specifically, because each inner box side flap is configured to engage with an engaging element on an inner surface of a respective outer sleeve side wall, the inner box side flaps underlie their respective outer sleeve side walls and thus are at least partially hidden.

A locking element which has minimal or no visual impact on the outer appearance of the container may provide a number of advantages. For example, having minimal or no visual impact on the outer appearance of the container can help to prevent ingress of particles into the container, by minimising or avoiding cracks or gaps on the outer surface of the container. Furthermore, having minimal or no visual impact on the outer appearance of the container can help to ensure the outer surface of the container remains substantially smooth. This may be advantageous for one or both of transporting and manufacturing of the container. This may also be advantageous when printing the outer surface of the container.

The choice of using such a locking mechanism in a container having an inner box, which is slidable relative to an outer sleeve, can be particularly advantageous in reducing the risk of inadvertent opening of the container. This is because the action required to release the locking mechanism, may be a different action from the sliding action required to move the inner box relative to the outer sleeve. For example, a pressing action may be required to release the locking mechanism, whereas a sliding action may be required to move the inner box relative to the outer sleeve. The requirement for such different and distinct actions, can make it even less likely for the container to be opened inadvertently.

By providing the container with a locking mechanism comprising a flap positioned at each side wall of the inner box, the risk of inadvertent opening of the container can be further reduced. This is because both sides of the container need to be interacted with at the same time due to the positioning of the inner box side flaps. Accordingly, a pressing force may be required from two opposing sides of the container in order to unlock the locking mechanism. Such dual opposing pressing forces may be unlikely to occur during normal handling and normal transport of the container.

The locking mechanism of the present invention may be particularly advantageous in embodiments where the width of the container is greater than the height of the container. Preferably, the width of the of the container is greater than height of the container. For example, preferably the aspect ratio of the container may be such that the width of the container is greater than 120% of the height of the container, more preferably the width of the container is greater than 130% of the height of the container, most preferably the width of the container is greater than 140%. Preferably, the aspect ratio of the container may be such that the width of the container is less than 300% of the height of the container, more preferably the width of the container is less than 250% of the height of the container, even more preferably the width of the container is less than 220% of the height of the container. For example, preferably the width of the container is greater than 75 mm, more preferably the width of the container is greater than 80 mm, most preferably the width of the container is greater than 85 mm or 90 mm. The width of the container is preferably less than 200 mm, more preferably less than 150 mm. This is because in such embodiments, a user is less likely to hold both sides of the container with one hand at any one time. As such, the user is less likely to be applying a pressing force to both sides of the container at the same time, during normal handling of the container. This, in combination with the sliding action required to move the inner box relative to the outer sleeve from the first position to the second position, make it unlikely that the container will be inadvertently opened.

The edge of each inner box side flap, which is configured to engage with a corresponding engaging element on a respective outer sleeve side wall, is preferably a free edge of the inner box side flap. A free edge of a flap is one which does not directly connect the flap to the article from which it depends.

The free edge of the inner box side flap is preferably a leading edge of the inner box side flap. That is, the free edge of each inner box side flap configured to engage with a corresponding engaging element on a respective outer sleeve side wall, is preferably positioned opposite to an edge of the inner box side flap which connects the inner box side flap to the rest of the inner box.

The inner box is configured to be slidable with respect to the outer sleeve. The outer sleeve may therefore have an interior configured to receive the inner box. The outer sleeve may comprise a second end positioned opposite to the first open end of the outer sleeve. The second end of the outer sleeve may comprise an outer sleeve bottom wall. Therefore, the outer sleeve may have a first open end, and a second end comprising the outer sleeve bottom wall, with the outer sleeve front wall, outer sleeve back wall and first and second opposed outer sleeve side walls extending between the first open end of the outer sleeve and the bottom wall of the outer sleeve.

The inner box is movable with respect to the outer sleeve between: a first position, in which the interior of the inner box cannot be accessed by a user; and a second position, in which the interior of the inner box can be accessed by a user. The first position may be regarded as a closed position. The second position may be regarded as an open position. When the inner box is in the second position, the interior of the inner box may be directly accessible for a user. That is, a user may not be required to do anything further to the container in order to be able to access any consumer goods held within the interior of the inner box. Alternatively in some embodiments, when the inner box is in the second position, a user may be required to move a lid of the inner box in order to access any consumer goods held within the interior of the inner box. For example, the inner box may comprise a box portion and a lid portion attached to the box portion, the lid portion being configured to cover an access opening of the box portion of the inner box. The lid portion may be moveable relative to the box portion between: a closed position, in which the lid portion covers the access opening of the box portion, and an open position, in which any consumer goods held within the interior of the box portion can be accessed through the access opening of the box portion. The lid portion may be hingedly connected to the box portion, and configured to pivot between the open position and the closed position.

The container may be configured so that the lid portion of the inner box cannot move between the open position and the closed position, when the inner box is in the first position. For example, when the inner box is in the first position, one or more walls of the outer sleeve may prevent the lid portion of the inner box from moving between the open position and the closed position. The walls of the outer sleeve may act to retain the lid portion of the inner box in the closed position, when the inner box is in the first position.

Movement of the inner box from the first position to the second position may cause at least part of the inner box to pass through the open end of the outer sleeve. In particular, at least part of the inner box is configured to be slidable through the open end of the outer sleeve, and thus at least partially move out of the outer sleeve, as the inner box moves from the first position to the second position. This can help to improve the ease of access to any consumer goods held in the inner box, when the inner box is in the second position.

The outer sleeve and the inner box may be configured so that the majority or all of the inner box is enclosed by the outer sleeve when the inner box is in the first position. This can help to minimise the amount of surface area of the inner box, which can be accessed by a user when the inner box is in the first position.

Preferably, the outer sleeve and the inner box are configured so that at least one of the inner box front wall and the inner box back wall completely underlies its corresponding outer sleeve front wall and outer sleeve back wall, when the inner box is in the first position. In such embodiments, at least one of the inner box front wall and the inner box back wall will not be visible to a user, when the inner box is in the first position. This may help to limit the amount of surface area of the inner box, which a user may be able to grip, in order to slide the inner box from the first position to the second position. This may help to reduce the risk of the container being inadvertently opened. This may also help to enhance the amount of uninterrupted surface area, which is available for communication with the user at one or both of the front or back of the container, when the inner box is in the first position.

Preferably, part of the inner box does reside outside of the outer sleeve when the inner box is in the first position. More preferably, between about 5 percent and about 20 percent of the external surface area of the inner box resides outside of the outer sleeve when the inner box is in the first position. This can advantageously ensure that whilst most of the inner box is covered by the outer sleeve and cannot be touched by a user, a portion of the inner box can still be gripped by a user, when the inner box is in the first position. This can provide a balance between securing the inner box in a locked state, and helping a user to slide the inner box away from the outer sleeve when access to any consumer goods within the inner box is intended.

The open end of the outer sleeve may be angled relative to the longitudinal axis of the outer sleeve. More specifically, the length of the outer sleeve front wall may be less than the length of the outer sleeve back wall. Each outer sleeve side wall may therefore have a different length at the point at which said outer sleeve side wall connects to the outer sleeve back wall compared to the point at which said outer sleeve side wall connects to the outer sleeve front wall. This can define a sloped edge for each side wall at the open end of the outer sleeve, said sloped edge of each outer sleeve side wall being sloped relative to the longitudinal axis of the outer sleeve. Such arrangements can advantageously help to ensure that some of the inner box can be gripped by a user when the inner box is in the first position, without requiring the inner box to have an unconventional shape. In particular, in such embodiments the inner box may have a rectangular parallelepiped shape. This may be preferable from a manufacturing perspective. This may also be preferable from a storage perspective.

In the following description of the invention the terms "side", "top", "bottom", "front", "back" and other terms used to describe relative positions of the components of containers according to the invention refer to the container in an upright position with the access opening at the top. When describing containers according to the present invention, these terms are used irrespective of the orientation of the container being described. The "bottom" of the container refers to the side of the container opposite the "top" of the container.

The term "height" is used herein to refer to dimensions extending between the top and the bottom. The term "width" is used herein to refer to dimensions extending between two sides. The term "depth" is used herein to refer to dimensions extending between the front and the back. Height, width and depth are orthogonal to each other.

The term "panel" is used herein to refer to a portion of the container formed from a single, continuous portion of material. A panel may depend from one or more other panels.

The term "wall" refers more generally to a facet of the container, and a wall may be formed from a single panel or flap, or a wall may be formed from two or more abutting or overlapping panels or flaps.

The term "depending" is used herein to describe a physical connection between two elements of a container in accordance with the invention. In more detail, the term "depending" is used to indicate that there is a material continuity between two elements, such as two walls or panels of a container or blank. This encompasses both cases wherein a wall or panel depends directly from an adjacent wall or panel as well as cases wherein an intermediate wall or panel effectively connects two walls or panels.

By way of example, a side wall or panel may depend directly from an adjacent front wall or panel. In such case, the wall or panel typically depends along a fold line from the adjacent wall. As an alternative, especially in containers having curved or bevelled edges, a side wall or panel may depend indirectly from a front wall or panel. In such case a curved or bevelled edge wall or panel connects the side wall or panel and the front wall or panel. In the case of a bevelled edge, both side wall or panel and front wall or panel may depend from the connecting bevelled edge wall or panel along respective fold lines. This also applies to optional components of containers in accordance with the invention, for example to a reinforcing member provided in the form of an inner frame.

The term "hinge line" is used herein to refer to a line about which the lid may be pivoted in order to open the container. A hinge line may be, for example, a fold line or a score line. The hinge line about which the lid is connected to the box may coincide with an edge of the container, or the hinge line may extend across a wall of the container at a position that is spaced apart from the edges.

The term "inner surface" is used throughout the specification to refer to the surface of a component of the assembled container that is facing towards the interior of the container, for example towards the consumer goods, when the container is in the closed position. The term "outer surface" is used throughout the specification to refer to the surface of a component of the container that is facing towards the exterior of the container. For example, the front wall of the package has an inner surface that is facing the inside of the package and the consumer goods, and an outer surface facing away from the consumer goods. It should be noted that the inside or outside surface is not necessarily equivalent to a certain side of a blank used in assembly of the container. Depending on how the blank is folded around the consumer goods, areas that are on the same side of the blank can either face towards the inside or the towards the outside of the container.

The term "fold line" is used to describe any line of a blank about which the blank is folded. The fold line may be defined by a line of weakness to assist with the folding action. Alternatively, a fold can be formed without the presence of a weakening line, depending for example on the pliability of the blank material and other material characteristics.

When the locking mechanism of the container is engaged, the inner box is prevented from sliding from the first position to the second position with respect to the outer sleeve. Disengagement of the locking mechanism enables the inner box to be slidable with respect to the outer sleeve from the first position to the second position. Therefore, the container may be configured so that disengagement of each inner box side flap from its corresponding engaging element, allows the inner box to be slidable with respect to the outer sleeve from the first position to the second position.

Each outer sleeve side wall may be provided with a release element for enabling the edge of each inner box side flap to disengage from the corresponding engaging element of each outer sleeve side wall. The release element may be configured to enable the locking mechanism to transition from a locked state to an unlocked state in response to pressure exerted on the container by a user. In particular, the release element is configured to enable a user to interact with the locking mechanism to and cause the locking mechanism to transition into the unlocked state. Preferably, when the inner box is in the first position, each release element of the outer sleeve overlies at least a portion of its corresponding inner box side flap.

In some embodiments, each release element may comprise a cut-out in an outer sleeve side wall. The cut-out may be positioned adjacent to a portion of a corresponding inner box side flap, when the inner box is in the first position. In such embodiments, the cut-out can allow a user to directly access the inner box side flap and disengage the inner box side flap from the corresponding engaging element on the inner surface of the outer sleeve side wall. In particular, a user may insert their finger through the cut-out and push the inner box side flap away from the engaging element on the inner surface of the outer sleeve side wall to unlock the locking mechanism.

In some embodiments, the release element comprises a release tab formed by at least one cut line in an outer sleeve side wall. For example, each outer sleeve side wall may comprise a cut, which defines at least part of the perimeter of a release tab in said wall. The cut may be a U-shaped cut. The cut may be an arcuate cut. The release tab may be deflectable relative to the remainder of its outer sleeve side wall. This can allow the release tab to be moved independent of its outer sleeve side wall, in response to pressure from a user. The release tab may be positioned adjacent to a portion of its corresponding inner box side flap, when the inner box is in the first position. Thus, in use, a user can press on the release tab to translate a force to a corresponding inner box side flap to disengage the inner box side flap from the engaging element on the inner surface of the respective outer sleeve side wall.

By providing a release element in the form of a release tab, the means for unlocking the locking mechanism can be incorporated into the container with minimal visual impact on the container. The means for unlocking the container may therefore not be obviously visually apparent. This may therefore help to reduce the risk of the container being inadvertently opened.

The inner surface of each outer sleeve side wall comprises an engaging element for engaging with an edge of each inner box side flap, when the inner box is in the first position in the outer sleeve. The engaging element provides a barrier for engaging with the corresponding inner box side flap. In particular, the barrier may provide an engagement edge configured to abut the edge of its corresponding inner box side flap. The engaging element may be integrally formed with its corresponding outer sleeve side wall. For example, each outer sleeve side wall may be manufactured with a raised portion having an increased thickness to provide the engaging element on the inner surface of each outer sleeve side wall. Alternatively, the engaging element may comprise an element affixed to the inner surface of the outer sleeve side wall. The element may comprise a strip of material extending across the inner surface of the outer sleeve side wall.

The engaging element may be formed from a panel which is secured to part of the inner surface of its corresponding outer sleeve side wall. The panel may be connected to its corresponding outer sleeve side wall by a fold line, and folded about the fold line by about 180 degrees relative to its corresponding outer sleeve side wall.

The container may further comprise a holding mechanism for preventing the inner box from sliding beyond the second position. The holding mechanism may prevent the inner box from being separated from the outer sleeve. The holding mechanism may prevent the inner box from being completely removed from the outer sleeve.

The holding mechanism may advantageously provide a user with an indication that the inner box has reached the second position. More specifically, when the holding mechanism engages to prevent the inner box from sliding beyond the second position, the user may be provided with a tactile indication that the inner box has reached the second position. This may give a user an indication that the inner box is in a position in which they can access the consumer goods.

In some embodiments, the holding mechanism comprises an extendable member connecting a wall of the inner box to a wall of the outer sleeve. The extendable member is configured to change between a retracted state when the inner box is in the first position, and an extended state when the inner box is in the second position. The extendable member may be provided in the form of a strip of folded panels, with a first end panel of the strip being secured to a part of the outer sleeve and a second opposing end panel of the strip being secured to a part of the inner box. For example, the first end panel of the strip may be secured to the inner surface of an outer sleeve wall, such as an outer sleeve bottom wall. The second end panel may be secured to the outer surface of an inner box wall, such as the inner box bottom wall or the inner box top wall. The extendable member may therefore be concertina-like when it changes between its retracted and extended configurations.

The holding mechanism may comprise a flap on the outer sleeve. The flap on the outer sleeve may be configured to engage with a corresponding holding edge on the inner box to prevent the inner box from sliding beyond the second position. In particular, the flap may be configured to engage an edge of the inner box when the inner box is in the second position, to prevent the inner box from sliding beyond the second position.

The flap on the outer sleeve may depend from an edge of one of the outer sleeve walls. The flap on the outer sleeve may depend from an edge of the outer sleeve front wall. The flap on the outer sleeve may depend from an edge of the outer sleeve disposed at the open end of the outer sleeve. The flap on the outer sleeve may depend from a fold line on the outer sleeve, the fold line forming an edge of one of the outer sleeve walls. The flap on the outer sleeve may extend into the interior of the outer sleeve. For example, the flap may extend into the interior of the outer sleeve. The flap may be biased away from the wall from which it depends. The flap may have a contoured leading edge, for example a curved leading edge. This may facilitate engagement of the flap with the corresponding edge on the inner box.

In some embodiments, the flap on the outer sleeve depends from a fold line forming an edge of the outer sleeve front wall, the edge being disposed proximate to the outer sleeve opening and the flap extending into the interior of the outer sleeve and away from the outer sleeve front wall.

A flap having one or more of the above described features can provide a number of advantages. For example, the flap may be easy to manufacture, particularly if the flap depends from one of the existing walls of the outer sleeve. By arranging for the flap to depend from a fold line on the outer sleeve, the flap may be generally biased towards engagement with the edge on the inner box. This is particularly applicable when the flap extends into the interior of the outer sleeve and projects away from the wall from which it depends.

The holding edge of the inner box may be formed by a cut line on one of the walls of the inner box. The holding edge of the inner box may be formed by a cut line on the inner box back wall. The cut line may have an arcuate shape. For example, in some embodiments, the edge is formed from a cut line in the back wall or front wall of the inner box. By way of example, in some embodiments, the edge is formed from an arcuate cut line in the back wall of the inner box.

The inner box may comprise a box portion and a lid portion connected to the box portion by a hinge line. In such embodiments, the edge on the inner box configured to engage with a flap on the outer sleeve may be formed by an edge of the lid portion of the inner box. In such embodiments, the lid portion may engage with the flap when the inner box is in the second position and be held in a fixed position relative to the outer sleeve. However, advantageously, in such a position, the box portion of the inner box may be able to pivot about the hinge line to permit access to the interior of the inner box and any consumer goods housed therein. Accordingly, in such embodiments a user may be able to slide the inner box to the second position, and then pivot the box portion relative to the lid portion and outer sleeve to gain access to the interior of the inner box.

The box portion of the inner box may comprise a box portion front wall, box portion top wall, and first and second opposing box portion side walls. The box portion may have an interior configured to house one or more consumer goods.

The lid portion of the inner box may comprise a lid portion front wall, a lid portion back wall, a lid portion top wall and first and second opposing lid portion side walls. These walls may together provide the lid portion with a three-dimensional cup shaped lid.

The lid portion front wall, lid portion back wall and lid portion side walls may each abut corresponding walls of the box portion of the inner box, when the lid portion is in the closed position. The lid portion front wall, lid portion back wall and lid portion side walls may each be flush with the corresponding walls of the box portion of the inner box, when the lid portion is in the closed position.

The holding edge of the lid portion of the inner box, which is configured to engage with a flap on the outer sleeve, may be the lower edge of the lid portion front wall.

The flap of the outer sleeve may extend under the lid portion front wall when the inner box is in the second position. In such embodiments, the lid portion top wall may comprise a slot through which the leading edge of the flap of the outer sleeve extends when the inner box is in the second position. This may advantageously provide a point of engagement between the flap of the outer sleeve and the lid portion of the inner box. In particular, this may help to ensure that the flap of the outer sleeve can engage with the lid portion of the inner box in a reliable and consistent manner. In addition, the engagement may also help to reduce or avoid any relative movements between the lid portion of the inner box and the outer sleeve, when the inner box is in the second position. The slot may be provided proximate to the edge of the lid portion connecting the lid portion top wall and lid portion front wall. Such a position may be advantageous, because it can help to ensure that the flap of the outer sleeve lies flush against the inner surface of the lid portion front wall, when the inner box is in the second position. This may help to minimise the risk of the flap of the outer sleeve from interfering with other portions of the inner box, or any consumer goods container therein.

As noted above, the inner box may comprise: a box portion comprising a box portion bottom wall, a box portion front wall, a box portion back wall, and first and second opposed box portion side walls; and a lid portion hingedly attached to the box portion by a hinge line, the lid portion comprising a lid portion top wall, a lid portion front wall, a lid portion back wall, and first and second opposed lid portion side walls. In such embodiments, the container may be configured so that one or both of the hinge line and the lower edge of the lid portion front wall underlies a corresponding one of the outer sleeve front wall and outer sleeve back wall, when the inner box is in the first position. Such an arrangement can advantageously mean that the lid portion of the inner box is prevented from pivoting relative to the box portion of the inner box, when the inner box is in the first position. This can mean that a user is prevented from accessing any consumer goods held within the inner box, when the inner box is in the first position. In such embodiments, the container may be further configured so that one or both of the hinge line and the lower edge of the lid portion front wall is positioned externally of the outer sleeve, when the inner box is in the second position. Such an arrangement can advantageously mean that the lid portion of the inner box is able to pivot relative to the box portion of the inner box, when the inner box is in the second position. This may allow a user to access any consumer goods held within the inner box, when the inner box is in the second position.

In such embodiments, each of the first and second inner box side flaps may be configured to overlie a portion of the outer surface of a respective lid portion side wall. That is, the first inner box side flap may overlie a portion of the outer surface of the first lid portion side wall, and the second inner box side flap may overlie a portion of the outer surface of the second lid portion side wall. In such embodiments, each of the first and second inner box side flaps may depend from an edge of the lid portion which connects their respective lid portion side wall with the lid portion top wall. This may provide one or more advantages from a manufacturing perspective. For example, with such an arrangement the lid portion may be formed from a single laminar blank, with the first and second inner box side flaps being formed from the same single laminar blank. In particular, the first and second inner box side flaps may be formed from parts of the laminar blank which would normally be used to form reinforcing flaps for the lid portion. However, instead of being folded to reside inside the lid portion, said reinforcing flaps can be left unfolded such that they reside on the outside of the lid portion, and thus provide the first and second inner box side flaps. The first and second inner box side flaps may therefore be provided as part of an inner box, without substantially modifying one or both of the components and processes used to form said inner box.

Alternatively or additionally, each of the first and second inner box side flaps may be configured to overlie a portion of the outer surface of a respective box portion side wall. That is, the first inner box side flap may overlie a portion of the outer surface of the first box portion side wall, and the second inner box side flap may overlie a portion of the outer surface of the second box portion side wall. In such embodiments, each of the first and second inner box side flaps may depend from an edge of the box portion which connects their respective box portion side wall with the box portion bottom wall. This may provide one or more advantages from a manufacturing perspective. For example, with such an arrangement the box portion may be formed from a single laminar blank, with the first and second inner box side flaps being formed from the same single laminar blank. In particular, the first and second inner box side flaps may be formed from parts of the laminar blank which would normally be used to form reinforcing flaps for the box portion. However, instead of being folded to reside inside the box portion, said reinforcing flaps can be left unfolded such that they reside on the outside of the box portion, and thus provide the first and second inner box side flaps. The first and second inner box side flaps may therefore be provided as part of an inner box, without substantially modifying one or both of the components and processes used to form said inner box.

In the container or containers of the present disclosure described above the inner box is disposed within the outer sleeve. Therefore, it could be said that such containers are supplied to a user in a fully assembled condition, where the inner box is disposed within the outer sleeve. However, the present disclosure also contemplates arrangements whereby the inner box is initially supplied separately from the outer sleeve and a user inserts the inner box into the interior of the outer sleeve to form the fully assembled container.

According to the present disclosure, there is provided a kit of parts comprising an outer sleeve and an inner box configured to be received in the outer sleeve to form a container of the present disclosure. The kit of parts may comprise one or more instructions for how to insert the inner box into the outer sleeve to form the fully assembled container. Providing the container in the form of a kit of parts may be advantageous from a manufacturing perspective, because it means that a step of inserting the inner box into the outer sleeve can be performed by a user.

The present disclosure also concerns one or more laminar blanks for forming each of the outer sleeve and inner box of the container described above. Therefore, according to the present disclosure, there is provided a first laminar blank for forming the outer sleeve and a second laminar blank for forming the inner box. The outer sleeve may be formed of a single laminar blank and the inner box may be formed of a separate single laminar blank.

As noted above, containers according to the invention are preferably formed from one or more folded laminar blanks. The one or more laminar blanks may be formed from any suitable material or combination of materials including, but not limited to, cardboard, paperboard, plastic, metal, or combinations thereof. The different components of the container may be formed from the same material, or from different materials. Each of the one or more laminar blanks may be laminar cardboard blank having a weight of between about 100 grams per square metre and about 350 grams per square metre. In preferred embodiments, the blank has a thickness of from about 100 micrometres to about 500 micrometres, preferably from about 200 micrometres to about 350 micrometres.

The container is preferably a rectangular parallelepiped comprising two wider walls (front and back) spaced apart by two narrower side walls. Containers according to the invention may be in the shape of a rectangular parallelepiped, with right-angled longitudinal and right-angled transverse edges. The container may comprise one or more rounded longitudinal edges, rounded transverse edges, bevelled longitudinal edges or bevelled transverse edges, or combinations thereof.

The container may comprise a plurality of consumer goods. The consumer goods may be aerosol-generating articles. The aerosol-generating articles may be filter cigarettes or other smoking articles in which an aerosol-generating substrate comprises a tobacco material that is combusted to form smoke. The aerosol-generating articles may be articles in which a tobacco material is heated to form an aerosol, rather than combusted. The aerosol-generating articles may be articles in which a nicotine-containing aerosol is generated from a tobacco material, tobacco extract, or other nicotine source, without combustion, and in some cases without heating, for example through a chemical reaction.

The aerosol-generating articles may be provided within the container in the form of a bundle wrapped in an inner package formed of metal foil or metallised paper. The inner package material may be formed as a laminate of a metallised polyethylene film, and a liner material. The liner material may be a super-calendered glassine paper. In addition, the inner package material may be provided with a print-receptive top coating. The inner package has an access opening through which aerosol-generating articles can be removed when the lid of the container is in a respective open position.

Through an appropriate choice of the dimensions, containers according to the invention may be designed to hold different total numbers of aerosol-generating articles, or different arrangements of aerosol-generating articles. For example, through an appropriate choice of the dimensions, containers according to the invention may be designed to hold a total of between ten and thirty aerosol-generating articles. The aerosol-generating articles may be arranged in different collations, depending on the total number.

The invention will now be further described, by way of example only, with reference to the accompanying drawings in which.

Figure 1:
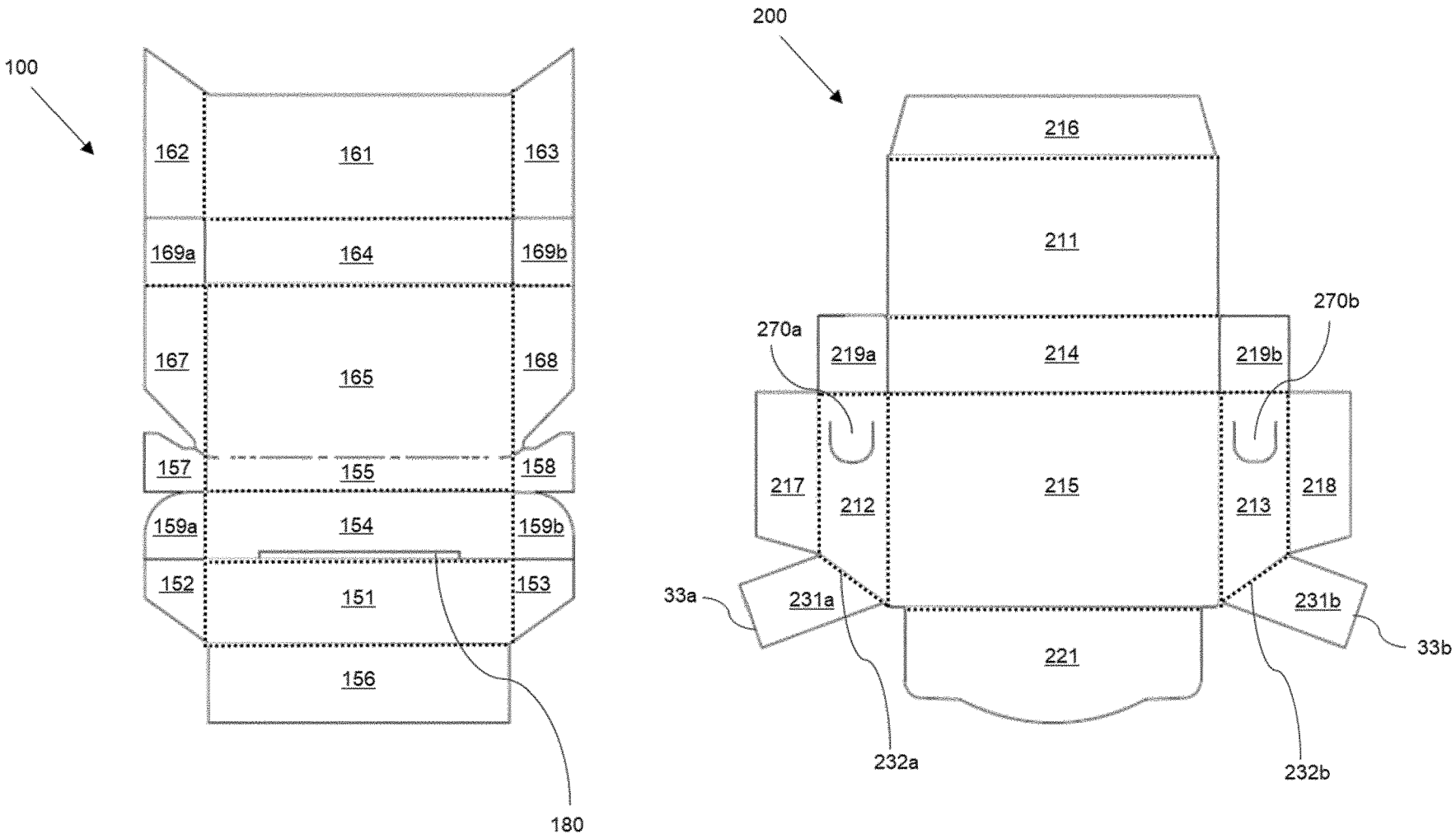
FIG. 1 shows a plurality of laminar blanks for forming a container according to a first embodiment of the present invention.
Figure 2A:
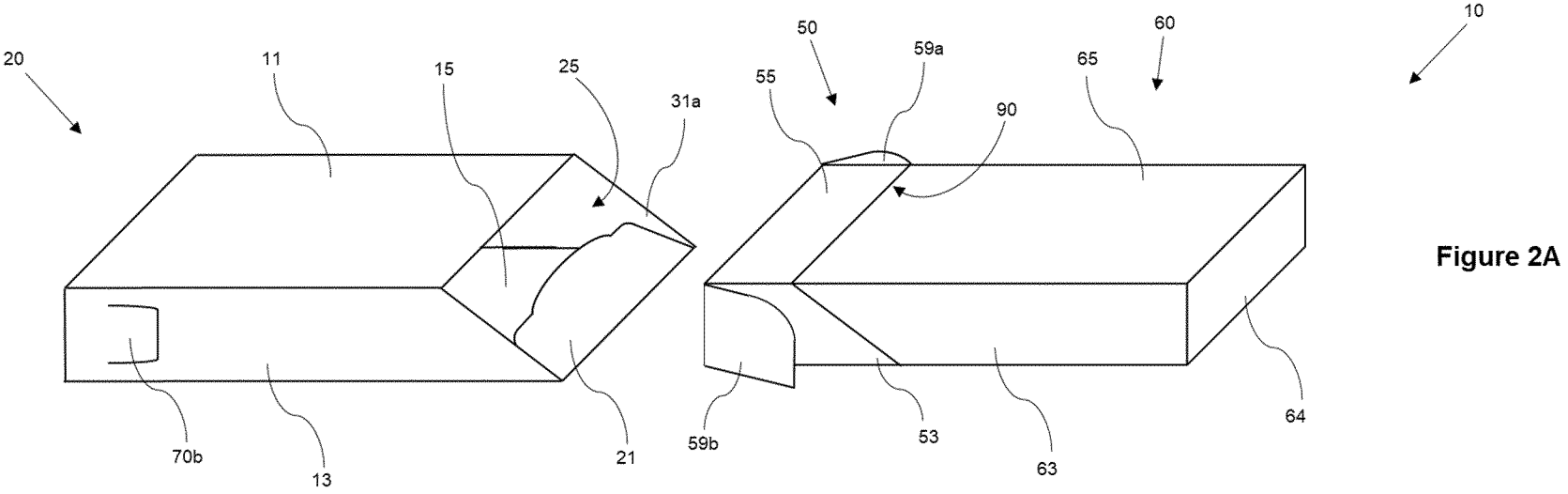
FIG. 2A shows an outer sleeve and an inner box for forming a container according to the first embodiment of the present invention.
Figure 2B:
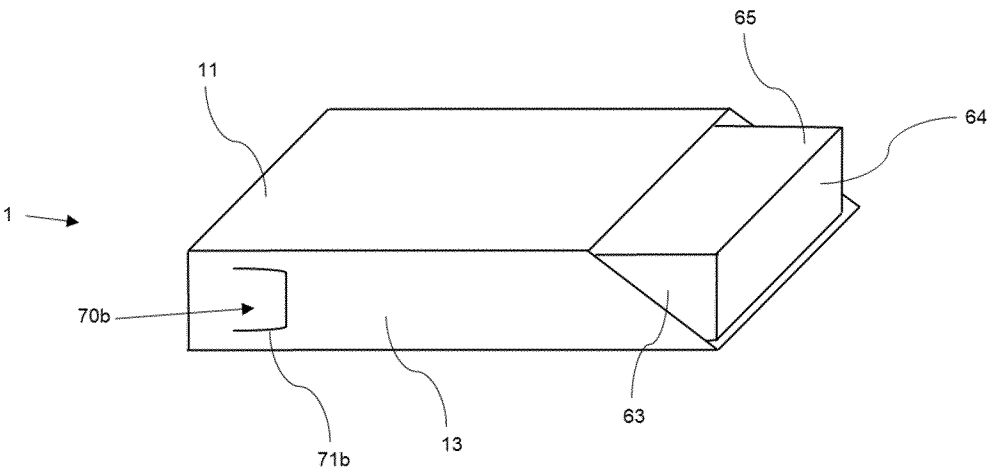
FIG. 2B shows a container according to the first embodiment of the present invention.

FIG. 1 shows two laminar blanks for forming a container 1 according to the present invention, namely a first laminar blank 100 and a second laminar blank 200. The laminar blanks can be used to form a container 1 as shown in FIG. 2B.

The first laminar blank 100 is configured to form an inner box 10 of the container 1. The inner box 10 comprises a lid portion 50 and a box portion 60.

The dashed lines indicate fold lines, and solid lines indicate cut lines in the laminar blank 100. The first laminar blank 100 comprises a lid portion front wall panel 151, first and second lid portion outer side wall panels 152, 153, a lid portion top wall panel 154, a lid portion back wall panel 155, a lid portion front under panel 156, and first and second lid portion inner side wall panels 157, 158. These panels together form the lid part of the lid portion 50 of the container 1. The lid portion top wall panel 154 includes a slot 180 for receiving a flap 21 of the outer sleeve 20, as will be described in more detail below.

The lid portion also includes panels 159*a*, 159*b* for respectively forming first and second inner box side flaps 59*a*, 59*b*. In a conventional laminar blank design, panels 159*a* and 159*b* would be connected by a fold line to panels 157 and 158 respectively, so as to form reinforcing flaps for the lid portion 50. However, in the first laminar blank of FIG. 1, panels 159*a* and 159*b* are separated from panels 157 and 158 by respective internal cut lines. This means that, during the manufacturing steps for forming the lid portion 50, panels 159*a* and 159*b* are not directly subjected to a folding step, when the panels 152 and 153 are folded with respect to the lid portion front wall panel 151. This means that when the lid portion 50 has been formed, the panels 159*a* and 159*b* can reside on the outside of the lid portion 50 to form the first and second inner box side flaps 59*a*, 59*b*, for example as shown in FIG. 2A.

The first laminar blank 100 further comprises a box portion front wall panel 161, first and second box portion outer side wall panels 162, 163, a box portion bottom wall panel 164, a box portion back wall panel 165, first and second box portion inner side wall panels 167, 168 and first and second box portion reinforcing flaps 169*a*, 169*b*. These panels together form the box portion 60 of the container 1.

The second laminar blank 200 comprises an outer sleeve front wall panel 215, first and second outer sleeve side wall panels 212, 213, an outer sleeve bottom wall panel 214, an outer sleeve back wall panel 211 an outer sleeve back wall under panel 216, first and second outer sleeve securing panels 217, 218, and first and second outer sleeve reinforcing flap panels 219*a*, 219*b*. These panels together form the outer sleeve 20 of the container 1.

The first and second outer sleeve securing panels 217, 218 are provided for securing the outer sleeve back wall panel 211 to the outer sleeve front wall panel 215 via the outer sleeve side wall panels 212, 213. In particular, when the outer sleeve 20 is assembled, the first and second outer sleeve securing panels 217, 218 are each affixed to the inner surface of the outer sleeve back wall panel 211, for example by an adhesive.

The second laminar blank further comprises an outer sleeve flap panel 221 depending from the outer sleeve front wall panel 215. When the outer sleeve 20 is assembled the outer sleeve flap panel 221 forms a flap 21 on the outer sleeve 20. The flap 21 depends from a fold line forming an edge of the outer sleeve front wall 15, the edge being disposed at the open end 25 of the outer sleeve 20. The flap 21 extends into the interior of the outer sleeve 20 and projects away from the outer sleeve front wall 15. This can be seen from FIG. 2A.

As will be described in more detail below with reference to FIGS. 2A and 2B, the flap 21 on the outer sleeve 20 defines a holding mechanism for preventing the inner box 10 from sliding beyond a set position.

The second laminar blank 200 further comprises first and second outer sleeve engaging panels 231*a*, 231*b*. These panels 231*a*, 231*b* respectively depend from the first and second outer sleeve side wall panels 212, 213. When the outer sleeve 20 is assembled by folding the second laminar blank 200, the first and second outer sleeve engaging panels 231*a*, 231*b* are folded about respective fold lines 232*a*, 232*b* in the second laminar blank 200, relative to the first and second outer sleeve side wall panels 212, 213. The first and second outer sleeve engaging panels 231*a*, 231*b* are then affixed to the inner surface of the outer sleeve side walls 12, 13 to form an engaging element 31*a*, 31*b* on the inner surface of each outer sleeve side wall 12, 13. Each engaging element 31*a*, 31*b* respectively defines an engagement edge 33*a*, 33*b* for engaging with a respective inner box side flap 59*a*, 59*b*.

The second laminar blank 200 further comprises a portion 270*a*, 270*b* on each of the first and second outer sleeve side wall panels 212, 213 for defining a release tab 70*a*, 70*b* in each outer sleeve side wall 12, 13. Each of these portions is partially delimited by a respective arcuate cut line 271*a*, 271*b* in each of the first and second outer sleeve side wall panels 212, 213. Each release tab 70*a*, 70*b* is configured to facilitate unlocking of a locking mechanism in the container, as will be described in more detail below with references to FIGS. 3A to 3C.

FIG. 2A shows an outer sleeve 20 and an inner box 10 formed from the laminar blanks of FIG. 1. The outer sleeve comprises an outer sleeve front wall 15, an outer sleeve back wall 11, an outer sleeve bottom wall, a first outer sleeve side wall, a second outer sleeve side wall 13, and an open end 25 at the opposite end of the outer sleeve 20 to the outer sleeve bottom wall. The first outer sleeve side wall is provided with a first release tab, and the second outer sleeve side wall 13 is provided with a second release tab 70*b*. An outer sleeve flap 21 depends from the edge of the outer sleeve front wall 15 and is disposed at the open end 25 of the outer sleeve 20. The outer sleeve flap 21 extends into the interior of the outer sleeve 20 and away from the outer sleeve front wall 15.

The inner box comprises a lid portion 50 and a box portion 60 connected together by a hinge line 90. The lid portion 50 comprises a lid portion top wall, a lid portion front wall, a lid portion back wall 55, a first lid portion side wall, and an opposed second lid portion side wall 53. The box portion 60 comprises a box portion bottom wall 64, a box portion front wall, a box portion back wall 65, a first box portion side wall, and an opposed second box portion side wall 63.

The inner box further comprises a first inner box side flap 59*a* and a second inner box side flap 59*b* each being configured to overlie a portion of a respective lid portion side wall.

The inner box 10 and outer sleeve 20 are shown in FIG. 2A in an unassembled condition. That is, the inner box 10 is separate from the outer sleeve 20. To assemble the inner box 10 and outer sleeve 20 into the container 1 of FIG. 2B, the inner box 10 is passed through the open end 25 of the outer sleeve 20 and inserted into the interior of the outer sleeve 20. Such insertion causes the outer sleeve flap 21 to be deflected towards the outer sleeve front wall 15, such that the outer sleeve flap 21 lies flush with the inner surface of the outer sleeve front wall 15.

Once the inner box 10 has been fully inserted into the outer sleeve 20 it resides in the position shown in FIG. 2B, a first position. In this position, the leading edge of each inner box side flap 59*a*, 59*b* engages with the leading edge 33*a*, 33*b* of the respective first and second outer sleeve engaging panels 231*a*, 231*b*. The first and second outer sleeve engaging panels 231*a*, 231*b* are respectively secured to the inner surface of the first and second outer sleeve side walls 12, 13. Such engagement acts to prevent the inner box 10 from being slidable with respect to the outer sleeve 20. The inner box 10 is therefore held in place within the outer sleeve 20 by virtue of such engagement. There is therefore a locking mechanism formed by the inner box 10 and outer sleeve 20. The locking mechanism acts to lock the inner box 10 in the outer sleeve 20 when in the position shown in FIG. 2B. This may be the configuration in which the container 1 is sold to a user.

To unlock the container 1, and thus gain access to the consumer goods, a user must first press the release tabs 70*a*, 70*b* on the outer sleeve side walls 12, 13. This will be described in more detail below with reference to FIGS. 3A, 3B and 3C.

Figure 3A:
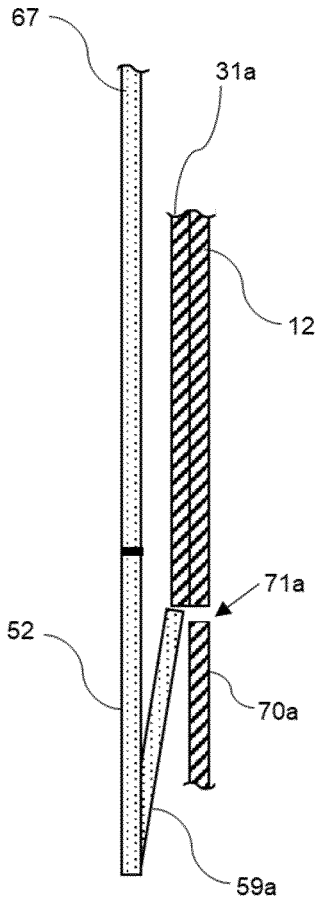
FIGS. 3A to 3C show cross-sectional views of a locking mechanism in different configurations for a container according to the first embodiment of present invention.
Figure 3B:
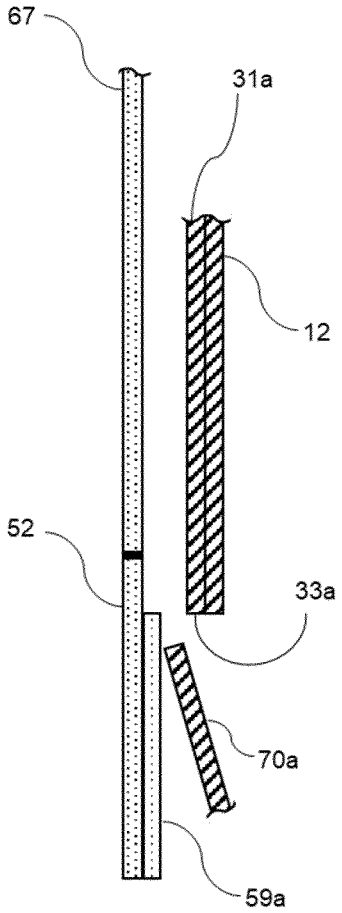
Figure 3C:
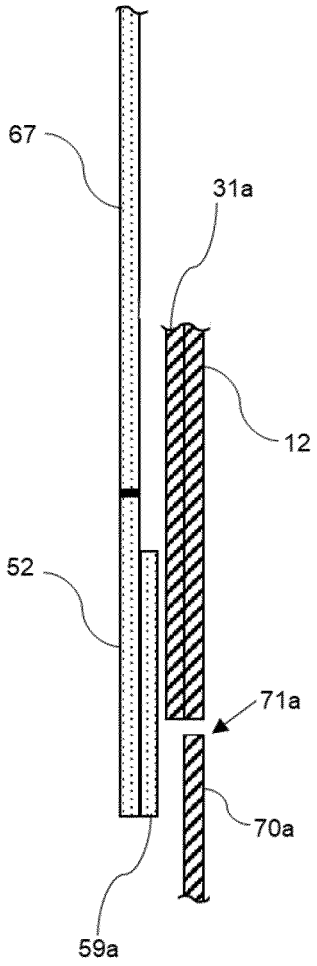

FIGS. 3A to 3C show a partial cross-sectional view of a locking mechanism for a container according to the present invention. The Figures depict the locking mechanism in various configurations.

The locking mechanism comprises a first inner box side flap 59*a* and a first engaging element 31*a*. The first engaging element 31*a* is formed by a first outer sleeve engaging panel 231*a* secured to the inner surface of the first outer sleeve side wall 12. The first outer sleeve side wall 12 includes an internal cut line 71*a*, which defines a release tab 70*a* in the first outer sleeve side wall 12. The release tab 70*a* is positioned to overlie the first inner box side flap 59*a*, when the inner box is in the first position, as shown in FIG. 3A. The first inner box side flap 59*a* depends from a lid portion 50 of the inner box 10 and overlies a portion of the first lid portion side wall 52 of the inner box 10.

The first engaging element 31*a* has an engaging edge 33*a*, which engages with the leading edge of the first inner box side flap 59*a*, when the container is in the first position, as shown in FIG. 3A, to prevent the inner box 10 from sliding towards and out of the open end of the outer sleeve 20.

In FIG. 3A the locking mechanism is in a locked state. To unlock the locking mechanism, a user presses on the release tab 70*a* to cause it to deflect inwards relative to the outer sleeve 20. The release tab 70*a* then comes into contact with the first inner box side flap 59*a* of the inner box 10 and pushes the first inner box side flap 59*a* away from the first engaging element 31*a* of the outer sleeve 20. This causes the leading edge of the first inner box side flap 59*a* to disengage from the barrier created by the first engaging element 31*a*, as shown in FIG. 3B.

FIG. 3B therefore shows the locking mechanism in an unlocked state, with the inner box 10 still being in the first position relative to the outer sleeve 20. However, because the locking mechanism is now unlocked, the inner box 10 can now move linearly relative to the outer sleeve 20 and towards a second position in which any consumer goods held in the inner box 10 can be accessed by a user. Consequently, after pressing on the release tab 70*a* and unlocking the locking mechanism, a user can slide the inner box 10 with respect to the outer sleeve 20 to gain access to the consumer goods. Such sliding movement is depicted by the change in position of the inner box 10 components relative to the outer sleeve 20 components between FIGS. 3B and 3C. In particular, the first lid portion side wall 52, first box portion side wall 67 and first inner box side flap 59*a* have all been moved upwards in FIG. 3C, relative to their position in FIG. 3B. FIG. 3C therefore shows the locking mechanism in an unlocked state, with the inner box 10 being in the second position.

When the user has finished accessing the consumer goods, the user can slide the inner box 10 back into the interior of the outer sleeve 20. This reverts the first inner box side flap 59*a* to a position corresponding to that shown in FIG. 3B. However, as the user is now no longer pressing on the release tab 70*a*, the first inner box side flap 59*a* of inner box 10 can move back to the position shown in FIG. 3A to engage with the first engaging element 31*a*. This results in the locking mechanism reverting to the locked state of FIG. 3A. The first inner box side flap 59*a* can automatically revert to the position shown in FIG. 3A in such circumstances, because of the biasing force created by the fold line between the first inner box side flap 59*a* and the panel 154 forming the lid portion top wall.

Although the locking mechanism has been described above with reference to the first inner box side flap 59*a* and first engaging element 31*a* shown in FIGS. 3A to 3C, it will be appreciated that the locking mechanism of the container 1 also comprises a corresponding arrangement on the opposed side of the container 1. In particular, the locking mechanism also involves a corresponding arrangement at the second inner box side wall and second outer sleeve side wall. Thus, in order to unlock a container as described above, a user is required to simultaneously press two release tabs 70*a*, 70*b* (i.e. one on each side wall of the outer sleeve 10).

As noted above, the outer sleeve 20 comprises a flap 21 which helps to form a holding mechanism for preventing the inner box 10 from sliding beyond a set position. In particular, the flap 21 is configured to engage with the lid portion 50 of the inner box 10, when the inner box 10 is in the second position to prevent the inner box 10 from sliding beyond the second position. In the arrangement of FIGS. 2A and 2B, this is achieved by virtue of the flap 21 sliding into the lid portion 50 as the inner box 10 is moved from the first position to the second position. In particular, as the inner box 10 is moved from the first position to the second position, the flap 21 catches on the lower edge of the lid portion front wall 51 and slides inside the lid portion 50. The flap 21 may remain generally flush with the inner surface of the lid portion front wall 51. When the inner box 10 reaches the second position, the curved part of the leading edge of the flap 21 protrudes through the slot 180 in the lid portion top wall 54. However, the flap 21 and slot 180 are shaped and sized so that part of the leading edge of the flap 21 protrudes through the slot 180 to engage with the lid portion top wall 54. This engagement prevents the inner box 10 from sliding any further beyond the second position.

Figure 4:
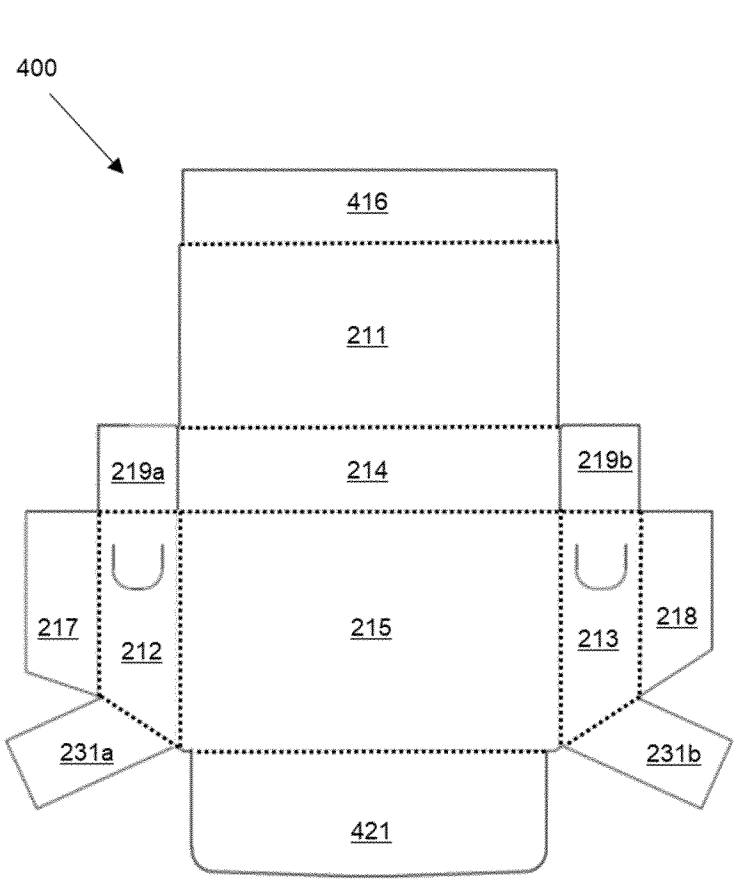
FIG. 4 shows a plurality of laminar blanks for forming a container according to a second embodiment of the present invention.
Figure 4:
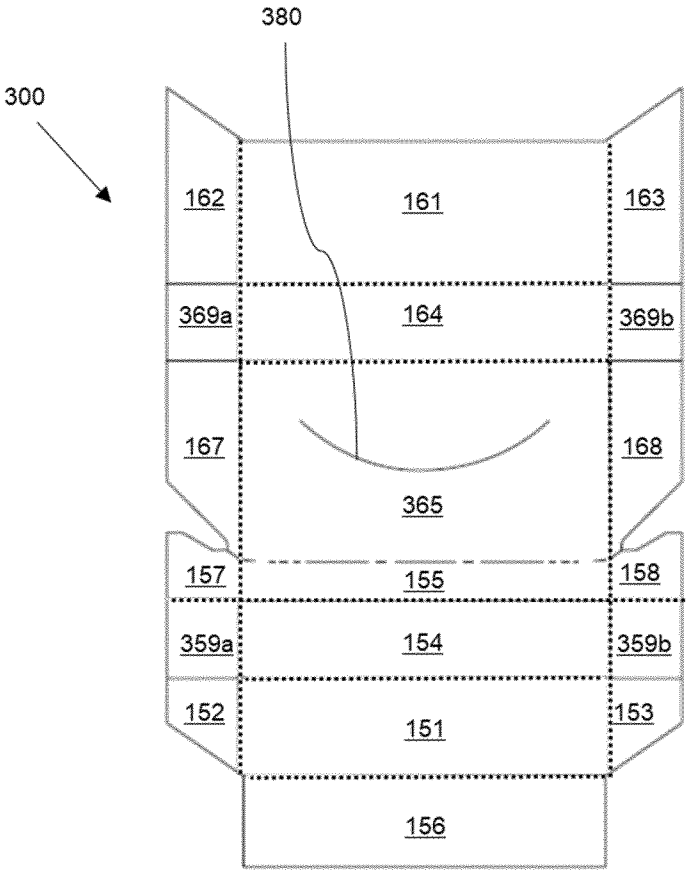
Figure 5A:
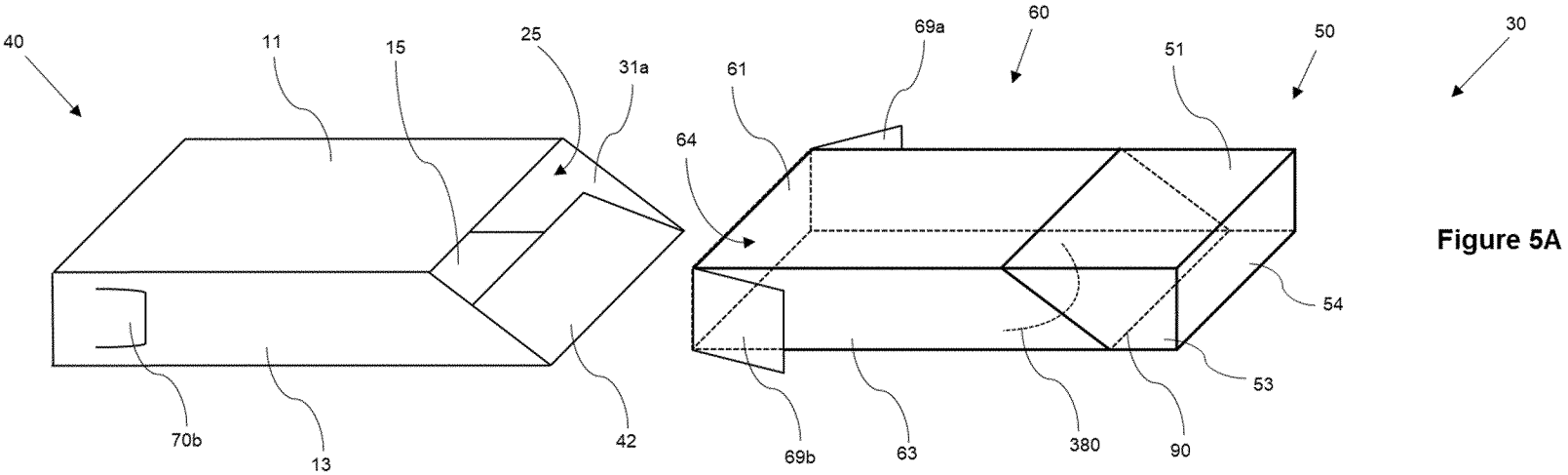
FIG. 5A shows an outer sleeve and an inner box for forming a container according to the second embodiment of the present invention.
Figure 5B:
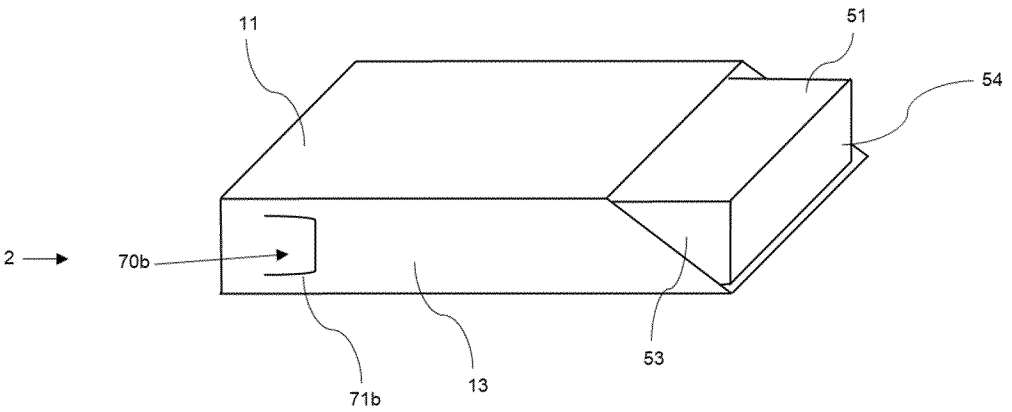
FIG. 5B shows a container according to the second embodiment of the present invention.

FIG. 4 shows a third laminar blank 300 and a fourth laminar blank 400 for forming a container according to a second embodiment of the present invention. The third laminar blank 300 is for forming an inner box 30 as shown in FIGS. 5A and 5B, and is similar to the first laminar blank 100 of the first embodiment of the present invention. The fourth laminar blank 400 is for forming an outer sleeve 40 as shown in FIGS. 5A and 5B, and is similar to the second laminar blank 200 of the first embodiment of the present invention. In particular, the container 2 and laminar blanks 300, 400 of the second embodiment are structurally and functionally the same as the container 1 and laminar blanks 100, 200 of the first embodiment, with the exception of the following points discussed below.

The third laminar blank 300 differs from the first laminar blank 100 in the following ways. Firstly, the third laminar blank 300 does not include a slot in its lid portion top wall 154. Instead, the third laminar blank 300 has an arcuate internal cut line 380 in its box portion back wall panel 365. Secondly, the internal cut lines are arranged differently in the third laminar blank 300 such that the third laminar blank 300 comprises first and second lid portion reinforcing flaps 359*a*, 359*b*, and first and second inner box side flaps 369*a*, 369*b*. This arrangement means that the first and second inner box side flaps 369*a*, 369*b* of the inner box 30 now depend from the box portion bottom wall 64 of the inner box 30, instead of the lid portion top wall 54 of the inner box 30. This can be best seen from FIG. 5A, where the inner box 30 is shown in a transparent form to enhance clarity.

The fourth laminar blank 400 differs from the second laminar blank 200 in the following ways. Firstly, the outer sleeve back wall under panel 416 of the fourth laminar blank 400 has a different shape compared to the outer sleeve back wall under panel 216 of the second laminar blank 200. Secondly, the outer sleeve flap panel 421 is shorter and no longer has a curved central portion on its leading edge.

FIG. 5A the outer sleeve 40 and inner box 30 of the second embodiment of the present invention, in an unassembled condition. The arrangement of FIG. 5A differs from that of FIG. 2A, at least in that the inner box 30 now has a different orientation relative to the outer sleeve 40. In particular, in FIG. 5A, the inner box 30 is now arranged so that the lid portion front wall 51 and box portion front wall 61 of the inner box 30, will underlie the outer sleeve back wall 11 when the inner box 30 is inserted into the outer sleeve 40. Similarly, the inner box 30 is now arranged so that the lid portion back wall 55 and box portion back wall 65 of the inner box 30, will underlie the outer sleeve front wall 15 when the inner box 30 is inserted into the outer sleeve 40.

As shown in FIG. 5B, when the inner box 30 is disposed in the first position in the outer sleeve 40, the bottom wall 64 of the inner box 30 underlies the bottom wall of the outer sleeve 40. Furthermore, part of the lid portion 50 of the inner box 30 extends through and resides externally of the open end 25 of the outer sleeve 40. The remaining part of the lid portion 50 of the inner box 30 resides within the outer sleeve 40. In this position, the hinge line 90 of the inner box 30 underlies the outer sleeve front wall 15, and the lower edge of the lid portion front wall 51 underlies the outer sleeve back wall 11. This arrangement prevents the lid portion 50 of the inner box 30 from pivoting relative to the box portion 60 of the inner box 30, when the inner box 30 is in the first position of FIG. 5B.

In the second embodiment of FIGS. 5A and 5B when the inner box 30 is moved to its second position the entire lid portion 50 of the inner box has been moved through the open end 25 and positioned externally of the outer sleeve 40. This allows the lid portion 50 to pivot about its hinge line 90 and permit access to the interior of the inner box 30. In particular, in the second position, the hinge line 90 of the inner box 30 is positioned beyond the upper edge of the outer sleeve front wall 15. Furthermore, the lower edge of the lid portion front wall 51 is positioned beyond the upper edge of the outer sleeve back wall 11. This allows the lid portion 30 to pivot about the hinge line 90 without being impeded by the outer sleeve 40.

The container 2 of the second embodiment includes a holding mechanism provided by the arcuate cut line 380 in the box portion back wall 65 of the inner box 30 and the outer sleeve flap 42. In particular, when the inner box 30 is moved to the second position, the outer sleeve flap 42 engages with an edge in the box portion back wall 65 created by the arcuate cut line 380 to prevent the inner box 30 from sliding beyond the second position. This prevents the inner box from being separated from the outer sleeve 40. This functions in a similar manner to the slot 180 and outer sleeve flap 21 arrangement of the first embodiment.

The invention claimed is:

1. A container for consumer goods, the container comprising:

an outer sleeve comprising an outer sleeve front wall, an outer sleeve back wall, first and second opposed outer sleeve side walls, an outer sleeve top wall, and a first open end; and an inner box comprising: a box portion comprising a box portion bottom wall, a box portion front wall, a box portion back wall, and first and second opposed box portion side walls; and a lid portion hingedly attached to the box portion along a hinge line, the lid portion comprising a lid portion top wall, a lid portion front wall, a lid portion back wall, and first and second opposed lid portion side walls, the inner box being disposed within the outer sleeve and configured to be slidable with respect to the outer sleeve between:

a first position, in which the interior of the inner box cannot be accessed by a user; and a second position, in which the interior of the inner box can be accessed by a user, wherein sliding of the inner box from the first position to the second position involves at least part of the inner box passing through the outer sleeve opening;

wherein the inner box further comprises first and second inner box side flaps, each inner box side flap being configured to overlie a portion of the outer surface of a respective box portion side wall or lid portion side wall;

wherein, when the inner box is in the first position in the outer sleeve, an edge of each inner box side flap is configured to engage with a corresponding engaging element on the inner surface of a respective outer sleeve side wall, to form a locking mechanism for preventing the inner box from sliding from the first position to the second position wherein each of the first and second inner box side flaps is directly connected to a first and second edge, respectively, of the box portion bottom wall by a first and second fold line, respectively; or wherein each of the first and second inner box side flaps is directly connected to a first and second edge, respectively, of the lid portion top wall by a third and fourth fold line, respectively.

2. The container according to claim 1, wherein each outer sleeve side wall is provided with a release element for enabling the edge of each inner box side flap to disengage from the corresponding engaging element of each outer sleeve side wall.

3. The container according to claim 2, wherein the release element comprises a release tab formed by at least one cut-line on the outer sleeve side wall.

4. The container according to claim 2, wherein, when the inner box is in the first position in the outer sleeve, the release element of each outer sleeve side wall overlies at least a portion of the corresponding inner box side flap.

5. The container according to claim 1, wherein disengagement of the locking mechanism enables the inner box to be slidable with respect to the outer sleeve from the first position to the second position.

6. The container according to claim 1, wherein the container further comprises a holding mechanism for preventing the inner box from sliding beyond the second position.

7. The container according to claim 6, wherein the holding mechanism comprises a flap on the outer sleeve which is configured to engage with a corresponding holding edge on the inner box to prevent the inner box from sliding beyond the second position.

8. The container according to claim 7, wherein the holding edge on the inner box is formed by a cut-line in the inner box back wall or the inner box front wall.

9. The container according to claim 7, wherein the inner box comprises a box portion and a lid portion connected to the box portion by a hinge line, and wherein the holding edge on the inner box is formed by an edge of the lid portion of the inner box.

10. The container according to claim 9, wherein one or both of the hinge line and a lower edge of the lid portion front wall is configured to underlie a corresponding one of the outer sleeve front wall and outer sleeve back wall, when the inner box is in the first position.

11. The container according to claim 1, wherein the inner box and the outer sleeve are configured such that at least one of the inner box front wall and the inner box back wall completely underlies its corresponding outer sleeve front wall and outer sleeve back wall, when the inner box is in the first position.

* * * * *